US005664821A

United States Patent [19]

Crowson

[11] Patent Number: 5,664,821

[45] Date of Patent: Sep. 9, 1997

[54] FRAMEWORK FACILITATING POSITIONING OF A TOOL CHEST

[76] Inventor: Kelly L. Crowson, 24566 Settler's La., Junction City, Oreg. 97448

[21] Appl. No.: 615,508

[22] Filed: Mar. 11, 1996

[51] Int. Cl.[6] ..... B66C 1/62

[52] U.S. Cl. ..... 294/67.1; 294/67.5; 410/116

[58] Field of Search ..... 294/67.1, 67.21, 294/67.3, 67.5, 68.1, 68.3, 167, 169; 220/762–764, 773–776; 410/106, 116; 296/37.6

[56] References Cited

U.S. PATENT DOCUMENTS

| | | | |
|---|---|---|---|
| 1,148,679 | 8/1915 | Hoffer . | |
| 1,541,211 | 6/1925 | Ford | 294/169 |
| 3,549,190 | 12/1970 | Caldwell | 294/81 |
| 3,596,969 | 8/1971 | Rosa | 294/67 |
| 4,481,972 | 11/1984 | Stavlo | 294/67.1 |
| 4,597,602 | 7/1986 | McGriff | 294/81.3 |
| 4,884,683 | 12/1989 | Ford | 220/764 |
| 5,181,756 | 1/1993 | Yurick | 294/67.1 |

*Primary Examiner*—Dean Kramer
*Attorney, Agent, or Firm*—James D. Givnan, Jr.

[57] ABSTRACT

A framework having end members joined by longitudinal members to define an area for the reception of a tool chest. A bail assembly of the framework includes a cross member on which an eye equipped sleeve is positionable and lockable to permit lifting of the tool chest and framework in the horizontal regardless of being in an unbalanced state. Fittings on the end members receive turnbuckles for securing the framework and tool chest to a supporting surface such as the bed of a truck. Tool chest removal from the framework is prevented by a component of each end member overlying a tool chest handle.

5 Claims, 1 Drawing Sheet

FRAMEWORK FACILITATING POSITIONING OF A TOOL CHEST

BACKGROUND OF THE INVENTION

The present invention concerns generally large tool chests of the type used by professional mechanics.

In use are large tool chests which when provided with a full complement of tools may weigh two hundred pounds or more. When a mechanic's job entails the making of repairs at a remote job site, as for example, in the repair of farm equipment and large trucks, the mechanic must load his tool chest into a vehicle for travel to the job site. As tool chests, even the larger ones, provide no lift or attachment points for a cable the tool chest must be loaded into the vehicle by several men or perhaps a lift truck and at the end of the trip the operation reversed to return the tool chest to the mechanic's work station. In addition to the time and effort expended in accomplishing this task, there is a degree of risk to the workers and damage to the tool chest.

A complication in the lifting of a heavy tool chest is that the chest should be lifted in the horizontal to prevent shifting of tools and parts in the chest to avoid having to reorganize the tool chest after each repositioning or lifting.

A further problem encountered is that tool chests have hingedly mounted lids and series of drawers, the opening and closing of which must not be impeded during the job at hand. Further, the overall size of the tool chest should not be increased.

In the prior art are devices for attachment to a load with provision for positioning an eye for reception of a lifting cable to prevent tilting of a load. Examples of such devices are disclosed in U.S. Pat. Nos. 1,148,679; 3,549,190; 3,596,969 and 4,597,602, none of which are believed suitable for use with a tool chest.

SUMMARY OF THE PRESENT INVENTION

The present invention is embodied in a framework for reception of a tool chest to facilitate lifting of same into and out of the cargo areas of repair vehicles.

The framework includes welded frame members which form a partial enclosure into which a tool chest is positioned and in which it may remain for transport and when at the mechanic's work station in a shop. A framework bail is swingably mounted to enable storing of the bail in an inconspicuous manner rearward of the framework. A lift point of the bail assembly is adjustably mounted for positioning and locking the bail to ensure the chest remains at or near the horizontal during loading and unloading from a transporting vehicle. The took chest is confined in the framework by a framework member being located immediately above a handle of the tool chest. Further, the framework may include tie down appendages for convenient installation of locks which also cooperate with fittings in place on the transporting vehicle.

Important objectives of the present invention include the provision of a framework in which a tool chest may be more or less permanently installed to facilitate lifting of the chest into and out of repair vehicles for transport to a remote or emergency job site; the provision of a framework for a large tool chest to facilitate positioning the chest which does not add appreciably to the bulky nature of such tool chests to enable the tool chest to be left permanently in place in the framework; the provision of a framework which includes a bail on which is adjustably carried an eye for reception of a hook equipped cable or the like with the eye positionable to ensure lifting of the chest in a substantially horizontal conditon.

DETAILED DESCRIPTION OF THE PREFERRED EMBODIMENTS

Figure 1:
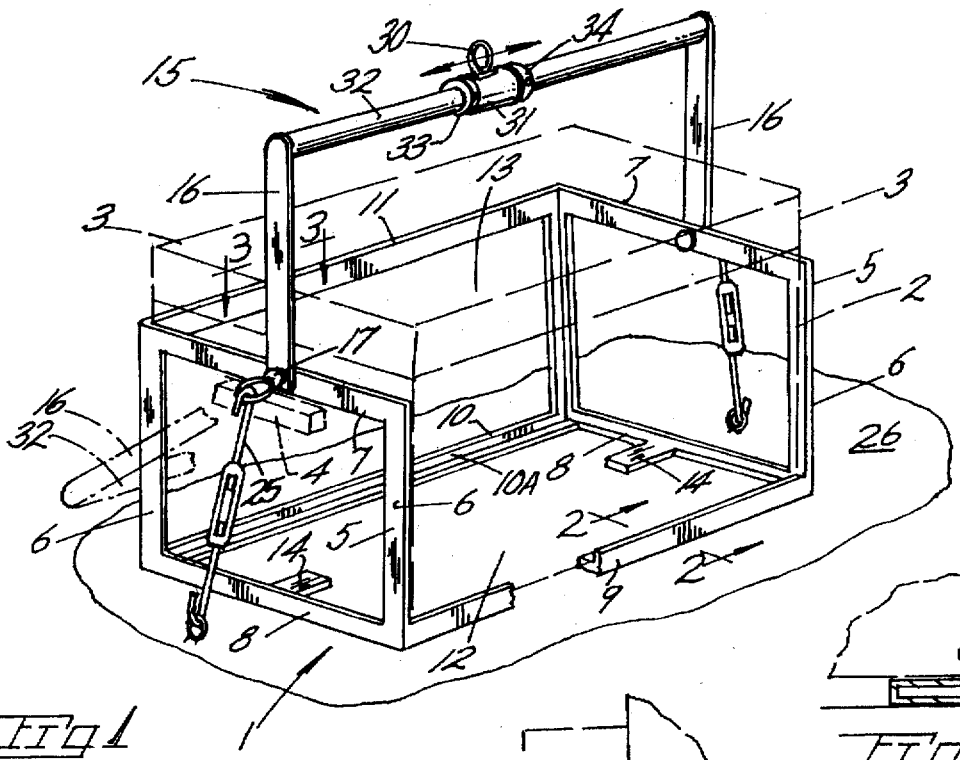
FIG. 1 is a perspective view of the present framework with a tool chest therein shown in phantom lines.
Figure 2:
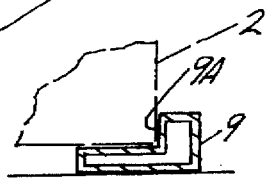
FIG. 2 is a vertical sectional view taken along line 2—2 of FIG. 1.
Figure 3:
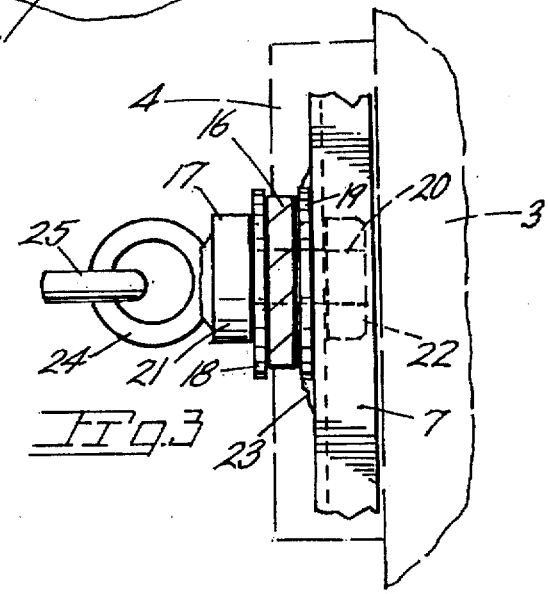
FIG. 3 is a horizontal view of bail attachment structure and taken along line 3—3 of FIG. 1.

With attention to the drawings wherein applied reference numerals indicate parts similarly hereinafter identified, the reference numeral 1 indicates generally the present framework of welded construction.

A tool chest is shown in phantom lines at 2 and includes a lid 3. A tool chest handle is at 4.

The framework includes upright end members 5 of rectangular shape each with a pair of vertical components 6 and a top component 7 of channel section. A lower component 8 of each end member is of tubular stock.

Longitudinal lower members of the framework are at 9 and 10. A shoulder at 9A and 10A on each of the members contributes to confining the tool chest against displacment during transport. A top longitudinal member is at 11. Accordingly, a frontal open area of the framework is provided at 12 while an upper open area at 13 is defined by the framework. The end members are in close proximity with the side walls of the tool chest. Framework extensions at 14 ensure a suitable lifting area surface of the framework.

A bail assembly is generally at 15 and includes arms 16 attached to the top components 7 of the framework by pivot means 17. Said pivot means includes a pintle 20 having a head 21 with the pintle extending through the end member to receive a nut 22 which is welded to the top component. A lower end of arm 16 is apertured to receive the pintle. Washers are at 18 and 19 with the latter tacked to the end member by welds 23. The pintle head 21 receives a ring at 24 with which a turnbuckle attached hook 25 may be engaged to secure the framework and tool chest therein against slippage on a supporting surface 26 which may be the bed of a truck.

An eye at 30 is carried by a sleeve 31 in place on a cross member 32 of the bail assembly. Locks at 33 and 34 confine sleeve 31 at a desired point therealong near or at the center of gravity of the tool chest and framework to ensure the chest remaining horizontal during lifting by the hook equipped cable of a hoist (not shown). The locks 33 and 34 may be embodied in rings each having a set screw for contact with cross member 32. Sleeve 31 may be positoned after partial lifting of the chest and framework indicates an adjustment is desired.

In use, the tool chest is positioned in the framework subsequent to removal of tool chest handles as at 4. Upon handle reattachment, the tool chest is prevented from upward displacement, relative the framework, as the handles are restricted by upper components 7 of the framework. Forward and rearward displacement of the tool chest is prevented by shoulders 9A and 10A of the lower longitudinal members of the framework. As large tool chests most often include locking means preventing access to the tool chest interior, removal of handles 4 by an unauthorized person is not possible. Theft of the combined tool chest and framework from a truck bed is not feasible by reason of weight which necessitates the use of a crane of the type commonly found in machine shops. Both during transport of the framework housed tool chest or at a mechanic's work station in a shop, bail assembly 15 is swung downward and to the rear of the framework so as to not hinder access to the tool chest interior. If desired, sheet material may be applied to the end members and to overlie longitudinal members 10 and 11 to prevent damage to the tool chest when carried in a truck bed with other equipment or supplies.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A framework for placement about a handle equipped tool chest to facilitate positioning of the tool chest on a surface, said framework comprising, end members of rectangular configuration, longitudinal members joining said end members, said members defining an open area for the reception of the tool chest, said end members having fittings for the reception of turnbuckles for framework tie down to the surface, a bail assembly including arms and a bar interconnecting the arms, a sleeve positionable along said bar and including an eye for reception of a lifting instrumentality, means limiting sleeve movement along said bar, and pivot means attaching said arms to said end members.

2. The framework claimed in claim 1 wherein said end members each include a horizontal component for disposition above a tool chest handle to prevent upward displacement of the tool chest relative the framework.

3. In combination, a tool chest including handles, a framework comprising end members of rectangular configuration, longitudinal members joining said end members, said members defining an open area for the reception of the tool chest, a bail assembly including arms and a bar interconnecting the arms, a sleeve positionable along said bar and including an eye for reception of a lifting instrumentality, means confining the sleeve along said bar, and pivot means attaching said arms to said end members.

4. The combination claimed in claim 3 wherein said end members include fittings for the reception of tie down devices.

5. The combination claimed in claim 3 wherein said end members of the framework each include a horizontal component for disposition respectively immediately above one of the tool chest handles to prevent upward displacement of the tool chest relative the framework.

* * * * *